United States Patent [19]

Weisbach

[11] 4,330,117

[45] * May 18, 1982

[54] METHOD AND DEVICE FOR ALIGNING SHEETS TO BE PRINTED IN A PRESS

[75] Inventor: Günter Weisbach, Radebeul, German Democratic Rep.

[73] Assignee: VEB Polygraph Leipzig, Kombinat für Polygraphische Maschinen und Ausruestungen, Leipzig, German Democratic Rep.

[ * ] Notice: The portion of the term of this patent subsequent to Mar. 24, 1998, has been disclaimed.

[21] Appl. No.: 162,103

[22] Filed: Jun. 23, 1980

Related U.S. Application Data

[63] Continuation of Ser. No. 941,139, Sep. 14, 1978, Pat. No. 4,257,586.

[30] Foreign Application Priority Data

Sep. 14, 1977 [DD] German Democratic Rep. ... 201016

[51] Int. Cl.[3] ..... B65H 9/00

[52] U.S. Cl. ..... 271/235; 271/237; 271/245; 271/250

[58] Field of Search ..... 271/235, 236, 237, 245, 271/250, 252

[56] References Cited

U.S. PATENT DOCUMENTS 2,011,745 8/1935 Wormser ..... 271/237 X 2,182,023 12/1939 Harrold ..... 271/237

2,812,940 11/1957 Kes ..... 271/235

4,060,237 11/1977 Degen ..... 271/237

*Primary Examiner*—Richard A. Schacher

*Attorney, Agent, or Firm*—Michael J. Striker

[57] ABSTRACT

The method comprises the steps of feeding from a stack of sheets to be printed the first sheet on a feedboard, aligning the leading edge of the sheet with a preliminary stop line whereby the sheet is brought to a rest position, sucking from below the preliminary aligned sheet and removing the preliminary stop line, forwarding the preliminary aligned and positively coupled sheet in feeding direction to a second stop line and relieving the suction whereby the leading edge of the sheet is finally aligned and a successive sheet is fed to the first stop line or the preliminary alignment of its leading edge, laterally adjusting the register of the first sheet abutting against the second stop line, removing the second stop line and advancing the first sheet into the press. The device for carrying out the above alignment process includes a feedboard having at its end front stops and at its central portion openings for preliminary front stops and elongated openings for reciprocating suction cups and furthermore lateral alignment devices arranged between the preliminary front stop and the final front stops. The drive of the preliminary front stop is effected through spring biased double-cam mechanism driven by a single revolution cam shaft.

9 Claims, 9 Drawing Figures

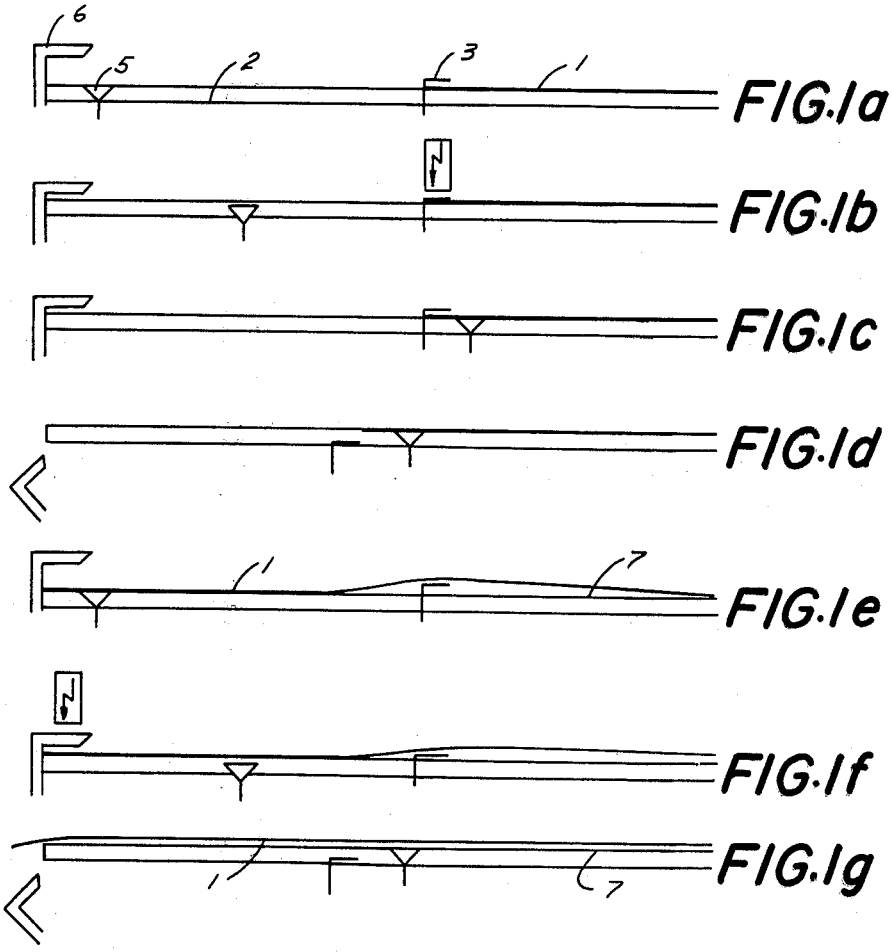
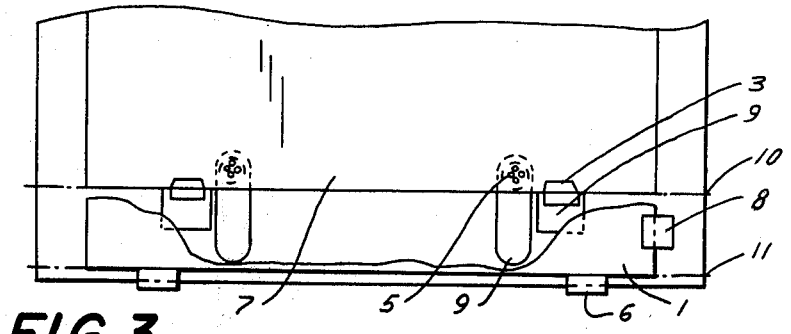
FIG.3

METHOD AND DEVICE FOR ALIGNING SHEETS TO BE PRINTED IN A PRESS

This is a continuation, of application Ser. No. 941,139, filed Sept. 14th, 1978 now U.S. Pat. No. 4,257,586.

BACKGROUND OF THE INVENTION

This invention relates generally to sheet fed presses and more particularly it relates to a method of and a device for alignment of sheets fed in a press.

The printing quality of high speed sheet fed presses is determined among other factors by the accuracy with which a sheet is aligned on a feedboard and advanced into the press. An increase of rotational speeds of the press has the consequence that the absolute time available for the alignment of leading and lateral edges of a sheet becomes reduced and this time reduction has disadvantageous effect on the prints. To obtain a good printing quality at high speed various devices have been proposed by means of which it is possible to increase the time period for the sheet alignment.

For example, German Pat. No. 682706 discloses a device for a preliminary alignment of a sheet by means of grippers. The sheet during its forward movement is engaged by the grippers (having different speed) and under constant deceleration is applied to the front stops whereby during the forward movement it is brought into alignment and brought against the front stops with a very low speed. The grippers can also momentarily stand still in their return position during the impact of the sheet against the stop.

The disadvantage of this known device is the fact that the grippers have to travel a long way in the reverse direction from the front stops before they resume their initial position. This long travel results in wasted time for the alignment process. Moreover, since the alignment takes place in movement, it is inaccurate. In addition, complicated and complex driving mechanism for controlling the grippers is necessary. An exact preliminary alignment of the sheet during the stationary position of its grippers cannot be made because the stationary condition of the grippers takes place only for a very short instant.

A device in which a sheet immediately upon its separation from the stack is preliminarily aligned by means of alignment stops is described in German Pat. No. 1,170,972. The alignment stops are arranged on a rotating drum. Upon the preliminary alignment the sheet is transported to the terminal stop by means of grippers. Also this device has the disadvantage that the alignment stops are rotatable. The preliminary alignment takes place therefore during a movement that is also momentary and therefore inaccurate.

In the U.S.S.R. Pat. No. 327076 is disclosed a device for a preliminary alignment of sheets that also includes stop members that catch the sheet during its movement and preliminarily align the same by using the speed difference therebetween. At the same time the sheet is checked out so that if a misalignment occurs, a suction device can be actuated that positively connects the sheets to the feedboard so that the latter cannot be advanced into the path.

Even in this device the preliminary alignment takes place during the movement of the sheet so that the accuracy of the preliminary alignment is very small. Besides this device is structurally very complicated and the blocking of misaligned sheets is also disadvantageous.

SUMMARY OF THE INVENTION

It is therefore a general object of the present invention to overcome the aforementioned disadvantages.

More particularly it is an object of this invention to provide an improved method and device for aligning sheets to be fed in a press which makes it possible to substantially increase the accuracy of alignment even at high rotational speed of the press.

Another object of the invention is to provide such an improved device that is simple in structure and reliable in operation.

An additional object of the invention is to provide a feeding method and device for sheets to be printed that results in an increased efficiency of the printing press while maintaining the standard printing quality.

In keeping with these objects and others which will become apparent hereafter, one feature of the invention resides, in an alignment process, by keeping the fed sheet on the feedboard of the press in a stationary condition for a time period that is longer than one working cycle of the machine and aligning the sheet during this stationary condition. According to this invention, the method of aligning the sheet comprises the steps of discharging the first sheet from a stack of sheets to be printed against a first alignment line provided on the feed table whereby the sheet is brought to rest and automatically aligned along its leading edge, thereafter sucking the sheet from below and removing the alignment line from the leading edge of the sheet, forwarding the positively coupled sheet in the feeding direction without losing the preliminarily aligned position thereof, applying the leading edge of the sheet against a second alignment line with a speed approaching zero whereby the front edge is finally aligned against the second alignment line, laterally pulling the sheets to align lateral edges of the sheet, removing the second alignment line and advancing the aligned sheet into the press. During the positive advance of the first sheet from the first alignment line to the second alignment line a successive sheet is discharged constantly from the stack of sheets and applied against the first alignment line. It is also possible after the preliminary alignment of the leading edge of the sheet make lateral preliminary alignments of the sheet during its stay on the first alignment line.

The device according to this invention comprises a feedboard or table that is provided at its central portion with first stop members extending along the preliminary alignment line and driven by a single revolution cam to perform a movement along a closed path, and further being provided with second stop members arranged in conventional manner at the end of the feedboard to define the second alignment line; lateral pull-in alignment devices are arranged between the first and second alignment lines or upstream of the first alignment line. A reciprocating slider carrying suction cups is arranged below the feedboard for positively connecting and transferring the stationary sheet from the first alignment line to the second alignment line without losing the preliminary alignment of the latter.

The feed table is provided with longitudinal openings for receiving the reciprocating suction devices and with openings for the preliminary stop members.

The driving mechanism for actuating the preliminary stop members consist of articulated arms and spring-biased cam followers controlled by a double cam assembly consisting of two cam discs supported on a single revolution cam shaft, of two cam followers supported on two jointed arms, one arm being journalled on a stationary pin and the other arm supporting at its free end the preliminary stop members.

By virtue of this multi-link cam mechanism according to this invention the sheet during its forward movement is two times stopped and brought to rest, first on the first alignment line formed by the preliminary stop members and thereafter after a positive displacement in feeding direction about a distance between the two alignment lines by the second alignment line consisting of the front stop members, whereby in both rest positions of the sheet the latter can be aligned laterally in conventional manner.

The alignment of the leading edge of the sheet takes place at both alignment lines by means of the alignment elements formed by the preliminary alignment stops and the final alignment stops that in the range of the alignment lines are controlled in such a manner that they either block the feeding track of the sheet (the alignment position) or clear the track (sheet feeding phase).

The total time reserved for the alignment of the leading edge and of the lateral edge is therefore longer than the time period of a press cycle (360°) so that the accuracy of alignment can be improved even at higher rotational speeds of the press.

Moreover, the provision of the second alignment line brings about the advantage that the sheet can be checked out already on the first alignment line as regards faulty sheets and double sheets.

Certain blocking functions for the case of stopping of the press that hitherto were performed by front stops or by preliminary grippers are taken over by the preliminary stop members or the adjustment device of this invention. The preliminary stops in the device of this invention that in comparison with preliminary grippers or front stops of prior art machines are less bulky, need for performing the blocking function less power. In addition, the available blocking period as mentioned above is now longer.

The novel features which are considered as characteristic for the invention are set forth in particular in the appended claims. The invention itself, however, both as to its construction and its method of operation, together with additional objects and advantages thereof, will be best understood from the following description of specific embodiment when read in connection with the accompanying drawing.

BRIEF DESCRIPTION OF THE DRAWING

FIGS. 1*a*–1*g* show schematically successive steps of the sheet alignment method of this invention;

FIG. 3 is a partially cut-away top view of the device of FIG. 2.

DESCRIPTION OF THE PREFERRED EMBODIMENT

Figure 2:
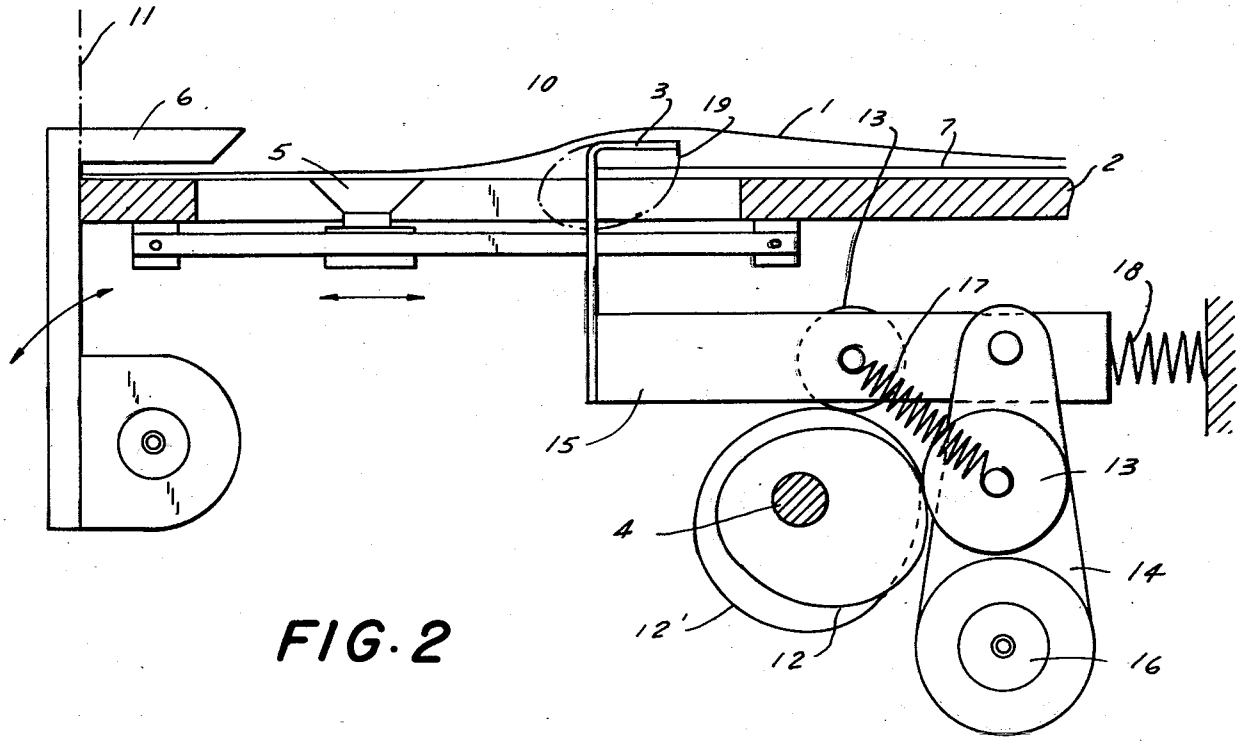
FIG. 2 is a side view of the sheet alignment device of this invention.

FIG. 1 shows schematically respective steps in the sheet alignment process of this invention. The first sheet 1 from a stack of sheets to be printed is first freely forwarded from the stack on a feedboard 2 and its movement is stopped by a preliminary front stop 3 that in this phase is in its catching position. The preliminary stop 3 brings the freely moving sheet 1 to rest and at the same time causes an automatic preliminary alignment of its leading edge (FIG. 1*a*). After the sheet 1 stands still and the preliminary alignment step is completed, a check out is made as far as faulty sheets or double sheets are concerned, whereby the hook-shaped preliminary stop member 3 is lowered by means of a cam mechanism driven by a single revolution shaft 4 rotating at the speed of the press and the stop member 3 bears against the leading edge portion of the sheet (FIG. 1*b*). Thereafter, as shown in FIG. 1*c*, a reciprocating section member 5 is displaced below the bottom surface of the sheet 1 and actuated to suck to the latter; thereafter, the preliminary stops 3 clear the path of movement of the sheet (FIG. 1*d*) and the reciprocating suction member 5 transfers the sheet 1 in feeding direction or as the case may be, laterally to the feeding direction parallel to the leading edges, as far as to the final front stops 6 and eject the sheet at a speed approaching or equal to zero, against the final front stop 6 (FIG. 1*e*). At the same time, preliminary front stops 3 are raised to the initial raised position for intercepting a successive sheet 7. The reciprocating suction member 5 moves again in the direction toward the preliminary front stops 3. The leading edge of the first sheet 1 is now finally aligned with the final stop 6 (FIG. 1*f*), and is also pulled laterally by conventional means so that also its lateral edges are aligned. Thereafter the final front stops 6 clear the way and the aligned sheet is fed into the press (FIG. 1*g*).

The alignment of the first sheet 1 against the final front stop 6 and the alignment of the successive sheet 7 against the preliminary front stops 3 and as well as release of the sheets 1 and 7 by the stops 6 and 3 occurs simultaneously or almost simultaneously.

Referring now to FIGS. 2 and 3, there is shown a device for carrying out the method illustrated in FIG. 1. The device includes a feed table 2, lateral pull devices 8, preliminary stops 3, final stops 6, reciprocating suction member 5, and a driving mechanism for the preliminary stops 3. The feeding table 2 is provided with longitudinal openings 9 extending in the feeding direction for the suction member 5 and with openings 9' for accommodating the preliminary stops 3. The preliminary stops 3 are arranged at the intermediate part of the feeding table 7 and extend over the entire width of the table and form the first alignment line 10 for the sheets. The final stops 6 are arranged at the end of the table 1 and form the second alignment line 11.

The construction of the final front stops 6, of the reciprocating suction member 5, as well as driving mechanism for the former and the control device for the suction air of the latter are known from prior art and need not be further described.

The driving mechanism for preliminary front stops 3 is in this example assembled of an articulated double-cam driving mechanism consisting of two cam discs 12 and 12' supported on a single revolution cam shaft 4 and cooperating with cam followers 13 and 13' that are supported respectively on a first cam follower lever 14 and a second cam follower lever 15. The first lever 14 is rotatably supported on a journal pin 16 and is pivotably connected to one end of the second lever 15. The cam follower 13' is urged into engagement with the cam 12' and the second cam follower 13 is urged into engagement with the cam 12 by means of tension spring 17 mounted between the both cam follower arms 14 and 15. The hook-shaped preliminary stops 3 are rigidly secured to the free end of the follower lever 15. The load equalization of the five member double-cam mechanism (12, 12', 13, 13', 14 and 15) is effected by means of a pressure spring 18 connected between the press frame and the cam follower lever 15.

The operation of the device of this invention as as follows:

During one working cycle of the press the preliminary front stops 3 move along a loop illustrated by a dash-and-dot line 19 FIG. 2. That means the stops 3 move from an elevated starting position (FIG. 1*a*) in which they prevent the movement of the sheet 1 across the alignment line 10, to an alignment position (FIG. 1*b*) in which the preliminary stops 3 remain lowered over an extended angular position of the cam shaft 4 in order that the leading edge of the sheet might be aligned, in a position below the feed table 2 to clear the way for the sheet 1 (FIG. 1*b*) so that the latter might be positively connected and transported by the reciprocating suction member 5 to the final front stops 6. A repeated alignment of the front edges and of lateral edges of the sheet 1 takes place in conventional manner at the final front stops 6 whereby adjustable brush rollers (not shown) act against the trailing edge of the sheet 1, the abutment of the sheet 1 against the final front stops 6 is effected by means of a suitable suction or similar alignment device. Upon the alignment of the leading edge of the sheet the lateral pull in devices 8 are actuated and adjust the lateral edge of the sheet 1. Thereupon the final front stop 6 clears away and the sheet is supplied in the press. Preliminary front stops 3, transporting suction member 5 and the final front stops 6 are thereby periodically actuated. The reciprocating suction member 5 can also be adjusted in such a manner that during transfer of the sheet from the preliminary front stops 3 to the final front stops 6 the successive sheet is laterally displaced from the sheet stack so that the entire lateral edge is released and tapered for engagement with the lateral pull in devices 8.

It will be understood that each of the elements described above, or two or more together, may also find a useful application in other types of constructions differing from the type described above.

While the invention has been illustrated and described as embodied in an alignment mechanism for use with sheet fed presses, it is not intended to be limited to the details shown, since various modifications and structural changes may be made without departing in any way from the spirit of the present invention. For example, the device can be modified in such a manner also a preliminary lateral alignment of the sheet can be made after the alignment of the leasing edges at the preliminary front stops 3. For this purpose a suction rail or similar pneumatic device can be provided below the sheet to act as the lateral pull in device 8.

What is claimed as new and desired to be protected by Letters Patent is set forth in the appended claims:

1. A method of aligning sheets on a feed table in preparation for advancement to a press, comprising the steps of feeding a shingled stream of sheets over the feed table, with a trailing portion of each preceding sheet overlapping a leading portion of the respective succeeding sheet; intercepting each preceding sheet at a stationary pre-alignment line of the feed table, to stop the sheet and effect automatic pre-alignment of its leading edge; advancing the thus pre-aligned preceding sheet, after clearing the way in feeding direction and without losing the pre-alignment, against a stationary final alignment line at a speed approaching zero to effect automatic final alignment of its leading edge; prealigning the succeeding sheet while the preliminary sheet travels to said stationary final alignment line and intercepting the respective succeeding sheet at said pre-alignment line; and releasing the preceding sheet for transportation from the final alignment line to the press and the succeeding sheet for advancement from the pre-alignment line to the final alignment line.

2. A method as defined in claim 1; and further comprising the step of laterally aligning each of said sheets while the respective sheet is located at said pre-alignment line.

3. A method as defined in claim 1; and further comprising the step of shifting each preceding sheet laterally with reference to the respective succeeding sheet by a constant distance during its advancement from said pre-alignment line to said final alignment line.

4. A method as defined in claim 1, comprising the step of laterally aligning edges of the preceding sheet located at said final alignment line.

5. Apparatus for aligning sheets which are being fed over a feed table towards a press, comprising first means for feeding a shingled stream of sheets over the feed table, with a trailing portion of each preceding sheet overlapping a leading portion of the respective succeeding sheet; second means for intercepting each preceding sheet at a stationary pre-alignment line of the feed table, to stop the sheet and effect automatic pre-alignment of its leading edge; third means for advancing the thus pre-aligned preceding sheet, after clearing the way in feeding direction and without losing the pre-alignment, in feeding direction and for releasing the same at a stationary final adjustment line at a speed approaching zero; fourth means for intercepting the preceding sheet at the stationary final alignment line, to again stop the preceding sheet and effect automatic final alignment of its leading edge, while the succeeding sheet is being intercepted by said second means at said pre-alignment line and pre-aligned during the travel of said preceding sheet to said stationary final alignment line; and additional means for releasing the preceding sheet at the final alignment line for transportation to the press and for releasing the succeeding sheet from the pre-alignment line for advancement by said third means to the final alignment line.

6. Apparatus as defined in claim 5, said third means comprising a suction device arranged for reciprocation beneath said sheets between the regions of said pre-alignment line and said final alignment line.

7. Apparatus as defined in claim 6, the feed table being provided with at least one longitudinal opening extending in the feeding direction of said sheets, and said suction device comprising at least one suction member reciprocable in said opening.

8. Apparatus as defined in claim 5, said second means comprising preliminary stop members mounted beneath the feed table, and drive means for raising and lowering said stop members through apertures in the feed table into and out of the path of sheets in said stream.

9. Apparatus as defined in claim 5, further comprising fifth means for aligning lateral edges of the preceding sheet which is located at said final alignment line.

* * * * *